US005460633A

United States Patent [19]

Smith et al.

[11] Patent Number: 5,460,633

[45] Date of Patent: Oct. 24, 1995

[54] FUEL OIL TREATMENT

[75] Inventors: Anthony K. Smith, Reading; Michael D. Sexton; Richard J. Hart, both of Didcot, all of United Kingdom

[73] Assignee: Exxon Chemical Patents Inc., Linden, N.J.

[21] Appl. No.: 167,920

[22] PCT Filed: Jul. 2, 1992

[86] PCT No.: PCT/EP92/01482

§ 371 Date: Feb. 28, 1994

§ 102(e) Date: Feb. 28, 1994

[87] PCT Pub. No.: WO93/01259

PCT Pub. Date: Jan. 21, 1993

[30] Foreign Application Priority Data

Jul. 2, 1991 [GB] United Kingdom ..... 9114236

[51] Int. Cl.[6] ..... C10L 1/22

[52] U.S. Cl. ..... 44/335; 44/342; 44/353; 44/329; 44/459; 585/10; 585/14

[58] Field of Search ..... 44/459, 335, 342, 44/353, 329; 585/10, 14

[56] References Cited

U.S. PATENT DOCUMENTS

| | | | |
|---|---|---|---|
| 3,838,990 | 10/1974 | Mieville | 44/459 |
| 3,846,093 | 11/1974 | Feldman | 44/459 |
| 4,175,926 | 11/1979 | Wisotsky | 44/459 |
| 4,211,534 | 7/1980 | Feldman | 44/459 |
| 4,678,479 | 7/1987 | Holmes et al. | 44/459 |
| 5,114,435 | 5/1992 | Abramo et al. | 44/459 |

*Primary Examiner*—Jacqueline V. Howard
*Attorney, Agent, or Firm*—John J. Mahon

[57] ABSTRACT

An additive comprising an oil-soluble polymer of a C2 to C6 mono-olefin such as polyisobutylene, which polymer has a molecular weight of less than about 500, is used in a fuel oil to reduce, on combustion of the fuel oil, one or more of particulate emissions, hydrocarbon emissions, carbon monoxide emissions, and oxides of nitrogen emissions.

5 Claims, No Drawings

FUEL OIL TREATMENT

This invention relates to the use of additives in fuel oils to reduce emissions on combustion of the fuel oil and to increase engine power when used in an internal combustion engine.

Although modern internal combustion engines are highly efficient and give almost complete combustion of the hydrocarbon fuel used, the slight reduction from total efficiency leads to the formation of black smoke, a proportion of which is particulate carbon and other products of incomplete combustion. Apart from the smoke being unpleasant to breathe and unsightly, the carbon particles may have absorbed in them polynuclear hydrocarbons, which also result from incomplete combustion, some of which are known carcinogens.

Furthermore, internal combustion engines give rise to gaseous emissions on combustion of fuel therein, examples of such emissions being one or more hydrocarbons, carbon monoxide, and oxides of nitrogen and which examples are noxious and undesirable.

This invention provides an additive for reducing one or more particulate and gaseous emissions, which additive is itself metal-free, the additive being a defined polymer of a $C_2$ to $C_6$ mono-olefin.

The use of polyolefins in middle distillate fuel oils has been described in the art. For example, GB-A-2 174 102 describes a diesel fuel composition containing a hydrocarbon diesel fuel, a polyolefin and a polyamine for keeping clean the injection system of diesel engines. Injector nozzle fouling is normally accompanied by an increase in particulate emissions.

Further, WO-A-8 600 333 describes a fuel comprising a gasoline, diesel fuel or heavy fuel oil and 0.3 to 0.8 wt % of a liquid poly-$C_3$-$C_6$-olefin, the fuel reducing the fuel consumption of a diesel engine.

Further, EP-A-376 563 describes a fuel additive, e.g. for diesel fuel, comprising a Mannich base and a polyalkylene, the additive having the effect of reducing intake-valve deposits.

The present invention is based on the observation that certain polymers of mono-olefins, when incorporated in a diesel, heating or jet fuel, reduce the emission of particulates even in the absence of injector deposits.

In a first aspect, the invention provides the use of an additive in a middle distillate fuel oil to reduce particulate emissions on combustion of the fuel oil other than the reduction resulting from a reduction in injector fueling in a diesel engine, of a polymer of a $C_2$ to $C_6$ mono-olefin, the polymer having a number average molecular weight of 350 to 1500. Reduction in fouling includes both the removal of existing injector nozzle deposits and the inhibition of deposit formation. The reduction in particulate emission achieved by the present invention may result directly on combustion of a fuel containing the polymer, compared with the emissions resulting from combustion, in the same combustion chamber with the same conditions upstream of the combustion chamber, of fuel not containing the polymer but otherwise identical. The reduction achieved by the first aspect of the invention is herein referred to as the "direct" reduction.

While the applicants do not wish to be bound by any theory, it is believed that under given conditions (which include any deposits present in injectors or elsewhere upstream of the combustion chamber) the presence of the polymer in the fuel, or in the fuel/air mixture, in the combustion chamber results in an improvement in the quality of combustion, as measured by completeness of oxidation. This improvement may in turn be the result of a change in the physical properties of the fuel, or the fuel/air mixture, e.g. the surface tension of the fuel, resulting in improved mixing and reduced soot and smoke formation. The reference above to the presence of the polymer includes the presence of a reaction product of the polymer with a component of the fuel, the reaction having taken place either before entry into the combustion chamber or within the combustion chamber prior to combustion.

In a second aspect, the invention provides the use of an additive in a middle distillate fuel oil to reduce particulate emissions on combustion of the fuel oil, the additive consisting essentially of a polymer of a $C_2$ to $C_6$ mono-olefin, the polymer having a number average molecular weight of 350 to 1500.

In a third aspect, the invention provides an additive composition comprising an additive combination of an ashless oil-soluble dispersant and a polymer of a $C_2$ to $C_6$ mono-olefin, the polymer having a number average molecular weight of 350 to less than about 500. Such a composition may be contained in a fuel oil composition as a minor proportion thereof, the fuel oil being a major proportion thereof; also, such a composition may be contained in a concentrate in admixture with a carrier liquid for addition to a fuel oil, containing for example 3 to 75 wt %, more preferably 3 to 60 wt %, most preferably 10 to 50 wt % of the additive composition in solution in a carrier liquid. Examples of carrier liquid are organic solvents including hydrocarbon solvents, for example petroleum fractions such as naphtha, kerosene and heater oil; aromatic hydrocarbons such as benzene, xylene and toluene; and paraffinic hydrocarbons such as hexane and pentane.

In a fourth aspect, the invention provides a fuel oil composition comprising a major proportion of a middle distillate fuel oil and a minor proportion of an additive consisting essentially of a polymer of a $C_2$ to $C_6$ mono-olefin, the polymer having a number average molecular weight of 350 to 1500.

In a fifth aspect, the invention provides a method of reducing particulate emission from a diesel engine which comprises supplying to the engine a middle distillate fuel oil containing an oil soluble polymer as defined in the first aspect of the invention in a proportion sufficient to reduce particulate emission from the engine operated on such fuel by reason of the presence of the polymer in the fuel or the fuel/air mixture in the combustion chamber.

The features of the invention will now be discussed in further detail.

Additive

Such a polymer may, for example, be a homo- or copolymer of ethylene, propylene, butylene (1- or 2-), pentylene or isobutylene, polyisobutylene being preferred. When it is a copolymer, it may be a copolymer of two or more of the specified monomers, or a copolymer of one or more of the specified monomers with a copolymerisable unsaturated monomer. Further, it may be a block or a random copolymer.

The number average molecular weight is as measured by Gel Permeation Chromatography (GPC). Preferably, it is in the range of 350 to 1000, e.g. to less than about 500, more preferably 350 to 450. The polymer may, for example, have a kinematic viscosity at 100° C. in the range of 1 to 20 cSt, preferably 4 to 16 cSt, more preferably 8 to 12 cSt.

The polymer may be made, for example, by catalysed polymerisation using cationic catalyst systems described in the art such as $AlCl_3/H_2O$; $AlCl_3/HCl$; Et $AlCl_2/HCl$; $BF_3$;

or Ziegler-Natta type catalysts.

The polymer is advantageously present in the fuel in a proportion in the range of from 5 to 10,000 ppm of active ingredient by weight based on the weight of the fuel, preferably from 50 to 5,000, more preferably from 100 to 2,000.

Co-Additives

The additives of the invention may be used in combination with one or more co-additives. Particular noteworthy co-additives are the ashless dispersants which are described in numerous patent specifications and which are additives that leave little or no metal-containing residue on combustion. Many classes are known such as described in EP-A-0 482 253 and to which attention is directed for further details thereof. The third aspect of the present invention requires the presence of an ashless oil-soluble dispersant. Examples of such co-additives are as follows:

(i) Macrocyclic Compound

Such a compound is an oil soluble compound of the formula

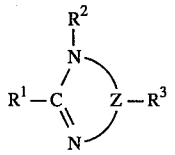

(I)

or $$R^6R^4N(R^5)_b[NR^4(R^5)_c]_dNR^4R^4$$

or mixtures of two or more such compounds, wherein $R^1$, $R^2$ and $R^3$ may be the same or different and are independently hydrogen or a hydrocarbyl substituent having from 2 to 600 carbon atoms, or a keto, hydroxy, nitro, cyano, or alkoxy derivative thereof, provided that at least one of $R^1$, $R^2$ and $R^3$ is a hydrocarbyl substituent having from 2 to 600 carbon atoms or said derivative thereof, or wherein $R^1$ and $R^2$ together form a hydrocarbylene substituent having 4 to 600 carbon atoms or a keto, hydroxy, nitro, cyano or alkoxy derivative thereof, provided that $R^1$ and $R^2$ together with the carbon atom which forms the C—R1 bond with $R^1$ and the nitrogen atom which forms the N—$R^2$ bond with $R^2$ form a ring having at least 5 members, wherein Z represents $$—R^{10}[NR^{11}(R^{10})]_e^-$$

$$—[R^{10}R^{11}N]_fR^{10}[NR^{11}R^{10}]_g^-$$

wherein each $R^{10}$, which may be the same or different, represents an alkylene group having from 1 to 5 carbon atoms in its chain, $R^{11}$ represents a hydrogen atom or a hydrocarbyl group, and e is from 0 to 6, f is from 1 to 4, g is from 1 to 4, provided that f+ g is at most 5, each $R^4$ is independently H or an alkyl group having up to 5 carbon atoms, R5 is an alkylene group having up to 6 carbon atoms in the chain, optionally substituted by one or more hydrocarbyl groups having up to 10 carbon atoms, an acyl group having from 2 to 10 carbon atoms, or a keto, hydroxy, nitro, cyano or alkoxy derivative of a hydrocarbyl group having from 1 to 10 carbon atoms or of an acyl group having from 2 to 10 carbon atoms, R6 is a hydrocarbyl substituent having from 2 to 600 carbon atoms or said derivative thereof, b is from 1 to 6, c is from 1 to 6 and d is from 0 to 12.

For example, the compounds of formula (I) may be

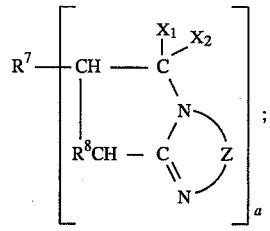

;

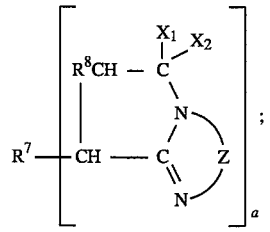

;

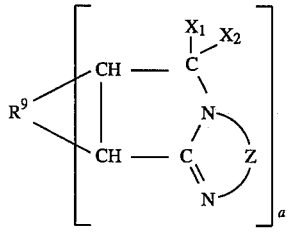

wherein $R^7$ is a hydrogen or a hydrocarbyl substituent having from 1 to 600 carbon atoms, $R^8$ is hydrogen or a $C_1$ to $C_{12}$ hydrocarbyl substituent, and if there is more than one $R^8$ in a compound, they may be the same or different, $R^9$ is a hydrocarbylene substituent having from 2 to 600 carbon atoms, two of which carbon atoms are bonded to the α-carbon atoms of the succinic anhydride based ring, $X_1$ represents hydrogen or an alkyl group having from 1 to 12 carbon atoms, $X_2$ represents hydrogen, an alkyl group having from 1 to 12 carbon atoms, a hydroxy group, or an alkoxy group, the alkoxy group having from 1 to 12 carbon atoms, or $X_1$ and $X_2$ may together represent an oxygen (or sulphur) atom, and a is 1 to 20.

Macrocyclic compounds such as the above are described in U.S. Pat. No. 4,637,886 and U.S. Pat. No. 4,880,923, both of which are incorporated herein by reference. When the invention is the use or the composition, the macrocylic compound, if present, is advantageously in a proportion in the range of from 5 to 20,000 ppm of active ingredient by weight based on the weight of the fuel oil, preferably from 10 to 5,000, more preferably from 50 to 3,000.

(ii) Cetane Improvers

It has been found that using a cetane improver in combination with the additive of the invention and optionally with a macrocyclic compound as described above may give rise to operational benefit.

Preferred cetane improvers are organic nitrates; there may also be used, for example, substituted triazoles and tetrazoles, for example those described in European Patent Application No 230783, the disclosure of which is incorporated herein by reference. Preferred organic nitrates are nitrate esters containing aliphatic or cycloaliphatic groups with up to 30 carbon atoms, preferably saturated groups, and preferably with up to 12 carbon atoms. As examples of such nitrates, there may be mentioned methyl, ethyl, propyl, isopropyl, butyl, amyl, hexyl, heptyl, octyl, iso-octyl, 2-ethylhexyl, nonyl, decyl, allyl, cyclopentyl, cyclohexyl, methylcyclohexyl, cyclododecyl, 2-ethoxyethyl, and 2-(2-ethoxyethoxy) ethyl nitrates.

When the invention is the use or the composition, the cetane improver is advantageously present in the fuel in a proportion in the range of from 5 to 10,000 ppm of active ingredient by weight based on the weight of the fuel, preferably from 50 to 5,000, more preferably from 100 to 2,000.

(iii) Substituted Succinimide or Succinamide

The presence of a hydrocarbyl-substituted succinimide or succinamide may also be advantageous, for example where the hydrocarbyl substituent is an olefin polymer substituent and the succinimide portion derived from a polyalkylene amine. Such materials are readily made be first reacting an olefinically unsaturated hydrocarbon of the desired molecular weight with maleic anhydride to form a hydrocarbyl-substituted succinic anhydride. Reaction temperatures of 100°–250° C. may be used. With higher boiling olefinically-unsaturated hydrocarbons, good results are obtained at 200°–250° C. This reaction can be promoted by the addition of chlorine. Typical olefins include cracked wax olefins, linear alpha olefins, branched chain alpha olefins, polymers and copolymers of lower olefins. These include polymers of ethylene, propylene, isobutylene, 1-hexene, 1-decene and the like. Useful copolymers are ethylene-propylene copolymers, ethylene-isobutylene copolymers, propylene-isobutylene copolymers, ethylene-1-decene copolymers and the like.

Hydrocarbyl substituents have also been made from olefin terpolymers. Very useful products have been made from ethylene-$C_{3-12}$ alpha olefin— $C_{5-12}$ non-conjugated diene terpolymers; such as ethylene-propylene-1,4-hexadiene terpolymer; ethylene-propylene-1,5-cyclooctadiene terpolymer; ethylene-propylene-norbornene terpolymers and the like.

Of the foregoing, by far the most useful hydrocarbyl substituents are derived from butene polymers, especially polymers of isobutylene.

The molecular weight of the hydrocarbyl substituent can vary over a wide range. It is desirable that the hydrocarbyl group have a molecular weight of at least 500. Although there is no critical upper limit, a preferred range is 500–500,000 number average molecular weight. The more preferred average molecular weight is 700–5,000 and most preferably 900–3,000.

Hydrocarbyl-substituted succinimides and succinamides are made by reaction of the desired hydrocarbyl-substituted succinic anhydride with an amine having at least one reactive hydrogen atom bonded to an amine nitrogen atom. Examples of these are methyl amine, dimethyl amine, n-butyl amine, di-(n-dodecyl) amine, N-(aminoethyl) piperidine, piperazine, N-(3-aminopropyl) piperazine, and the like.

Preferably, the amine has at least one reactive primary amine group capable of reacting to form the preferred succinimides. Examples of such primary amines are n-octyl amine, N-N-dimethyl-1,3-propane diamine, N-(3-aminopropyl) piperazine, 1,6-hexane diamine, and the like.

Hydroxyalkyl amines can also be used to make succinimide-succinamide components which contain some ester groups. These amines include ethanol amine, diethanol amine, 2-hydroxypropyl amine, N-hydroxyethyl ethylenediamine and the like. Such hydroxyalkyl amines can be made by reacting a lower alkylene oxide, such as ethylene oxide, propylene oxide or butylene oxide with ammonia or a primary or secondary amine such as ethylene diamine, diethylene triamine, triethylene tetramine, tetraethylenepentamine and the like.

A more preferred class of primary amines used to make the succinimide, succinamide or mixtures thereof are the polyalkylene amines. These are polyamines and the mixtures of polyamines which have the general formula $$H_2N\text{-}(R-NH)_n\text{-}H$$

wherein R is a divalent aliphatic hydrocarbon group having 2–4 carbon atoms and n is an integer from 1–10 including mixtures of such polyalkylene amines in a highly preferred embodiment, the polyalkylene amine is a polyethyleneamine containing 2–6 ethyleneamine units. These are represented by the above formula in which R is the group —$CH_2CH_2$— and n has a value of 2–6.

The amine used to make the succinimide, succinamide or a mixture thereof need not be all amine. A mono- or poly-hydroxyalcohol may be included in the reaction. Such alcohols can be reacted concurrently with the amine or the two alcohol and amine may be reacted sequentially. Useful alcohols are methanol, ethanol, n-dodecanol, 2-ethyl hexanol, ethylene glycol, propylene glycol, diethylene glycol, 2-ethoxy ethanol, trimethylol propane pentaerythritol, dipentaerythritol and the like.

Useful amine-alcohol products are described in U.S. Pat. No. 3,184,474; U.S. Pat. No. 3,576,743; U.S. Pat. No. 3,632,511; U.S. Pat. No. 3,804,763; U.S. Pat. No. 3,836,471;U.S. Pat. No. 3,836,471; U.S. Pat. No. 3,936,480; U.S. Pat. No. 3,948,800; U.S. Pat. No. 3,950,341; U.S. Pat. No. 3,957,854; U.S. Pat. No. 3,957,855; U.S. Pat. No. 3,991,098; U.S. Pat. No. 4,071,548 and U.S. Pat. No. 4,173,540.

The reaction between the hydrocarbyl-substituted succinic anhydride and the amine can be carried out by mixing the components and heating the mixture to a temperature high enough to cause a reaction to occur but not so high as to cause decomposition of the reactants or products or the anhydride may be heated to reaction temperature and the amine added over an extended period. A useful temperature is 100°–250° C. Best results are obtained by conducting the reaction at a temperature high enough to distill out water formed in the reaction.

(iv) Other Additive Components

In the practice of this invention, the additive or co-additives, if present, may be used in combination with one or more other additives, for example additives providing particular properties such as dispersants, for example metallic-based combustion improvers such as ferrocene; corrosion inhibitors; anti-oxidants such as amine-formaldehyde products; anti-foams; reodorants; anti-wear agents; flow improvers; wax anti-settling additives or other operability improvers; and cloud point depressants.

Examples of the above other additive components are known in the art. Such other additives may, for example, be present in the fuel oil in a proportion in the range of 5 to 500 ppm (weight:weight).

Proportions

Where the additive of the invention is used in combination with one or more coadditives, the relative proportion of the additives to one another may, for example, be in the weight:weight ratio of 500:1 to 1:500 such as 10:1 to 1:10.

Fuel Oil

The fuel oils that can be used are petroleum compositions comprising hydrocarbons such as straight chain paraffins, branched chain paraffins, olefins, aromatic hydrocarbons, and naphenic hydrocarbons, and hetero-atom containing derivatives of the above. The components of the fuel oil can be derived by any of the conventional refining and blending processes. Synthetic fuels are also included.

The fuel oils can be middle distillate fuel oils such as diesel fuel, aviation fuel, kerosene, fuel oil, jet fuel and heating oil. Generally, suitable distillate fuels are those boiling in the range of 120° C. to 500° C. (ASTM D-86). A heating oil may have a specification with a 10% distillation point no higher than 226° C., a 50% distillation point no higher than 282° C., and a 90% distillation point of at least 282° C. and no higher than about 338° C. to 343° C. or possibly 357° C. Heating oils are preferably a blend of virgin distillate, e.g. gas oil or naphtha, and cracked distillate, e.g. catalytic cycle stock. A diesel fuel may have a specification that includes a minimum flash point of 38° C. and a 90% distillation point between 282° C. and 338° C. (see ASTM Designations D-396 and D-975).

The additive and co-additives, if to be provided, may be added to the fuel oil as a mixture or separately in any order using conventional fuel additive injection methods, e.g. in the form of a concentrate.

EXAMPLES

The invention will now be particularly described by way of example only as follows:

Example 1

An additive comprising a polyisobutylene of number average molecular weight about 450 as measured by GPC was tested for its effect on hydrocarbon, carbon monoxide, oxides of nitrogen, and particulate emissions when added to a diesel fuel. The tests were carried out using untreated fuel and using fuel containing 500 ppm by weight of additive (active ingredient) per weight of fuel.

The untreated fuel used had the following characteristics:
Cloud point: −6° C.
Pour point: −27° C.
Cetane Number (CFR): 51.3

| Distillation Characteristics: | Volume % Off | Temp (°C.) |
|---|---|---|
| | Initial Boiling Point | 148 |
| | 5 | 194 |
| | 10 | 209 |
| | 20 | 229 |
| | 30 | 248 |
| | 40 | 263 |
| | 50 | 275 |
| | 60 | 286 |
| | 70 | 298 |
| | 80 | 312 |
| | 90 | 331 |
| | 95 | 345 |
| | Final Boiling Point | 367 |

The test was conducted according to the following protocol, using a 1.7 liter naturally-aspirated IDI diesel engine mounted in a passenger car and operated on a chassis dynamometer, in accordance with the standard ECE 15.04+ EUDC registered cycle.

Test Protocol

1. Using untreated fuel, a pre-test conditioning phase consisting of 3 EUDC cycles was performed.
2. The engine was left to soak at 21° C. overnight (a minimum of 12 hours).
3. A cold-start ECE 15.04+ EUDC cycle was performed, followed by two consecutive hot start ECE 15.04+ EUDC cycles. Emissions measurements were made during each of the three cycles, and the results averaged upon completion of the test.
4. The fuel tank was then drained and operations 1–3 repeated using fuel containing 500 ppm by weight of additive (active ingredient).

The results from this test are summarised in Table 1 below.

TABLE 1

| | HC | CO | $NO_x$ | Particulates |
|---|---|---|---|---|
| Untreated Fuel | 1.00 | 7.75 | 12.28 | 1.5034 |
| Treated Fuel | 1.08 | 7.93 | 11.12 | 1.3856 |

All figures represent g/kWh of the indicated emission, HC being hydrocarbons, CO being carbon monoxide, NO being oxides of nitrogen, and PARTICULATES being particulate matter collected via a conventional dilution tunnel.

The above results show that the additive reduced each of the oxides of nitrogen and particulates emissions.

Example 2

The additive of the invention was tested in a truck engine to determine its effect on Bosch Smoke. Bosch Smoke is a measure of the blackness of a filter paper through which exhaust gas has been drawn, in comparison with a numerical scale of zero (no deposit) to 10 (intense blackness). Bosch Smoke is found to correlate with the carbonised portion of the particulate emitted from a diesel engine.

The test engine was a Mercedes-Benz OM 366, being a 6 liter, 6 cylinder, 4-stroke naturally-aspirated DI truck engine. The engine was run at constant 90% rated load and 100% rated speed, the supply of fuel being switched instantaneously between untreated fuel and fuels containing polyisobutylene additives of differing number average molecular weights in order to measure changes in emissions due to the 'direct' effect described earlier.

The fuel used was a typical European automotive diesel oil.

The results are summarised in Table 2 below.

TABLE 2

| $M_n$ of Additive (polyisobutylene) | Concentration of Additive in Fuel (ppm) | Improvement in Bosch Smoke Reduction (%) |
|---|---|---|
| 320 | 600 | NIL |
| 320 | 5000 | −12 |
| 450 | 600 | NIL |
| 450 | 5000 | +12 |
| 950 | 500 | −4 |
| 950 | 5000 | +4 |

In the table, positive values indicate a reduction in Bosch smoke and negative values an increase therein.

It can be seen from the above results that most marked reduction in Bosch smoke is achieved when the additive had a number average molecular weight of 450 and was used at a concentration of 5000 ppm.

Example 3

Additive formulations of the invention were tested for their effect on hydrocarbon, carbon monoxide, oxides of nitrogen, and particulate emissions when added to diesel fuel.

The same engine as in Example 2 was used, the test being the "Regulation-49" cycle, a standard European truck cycle consisting of 13 steady-state modes corresponding to different speed/Icad settings for the engine, the emissions being weighted at different modes to emphasise the high speed conditions, in accordance with the test protocol. In particular, the engine was pre-conditioned on each test-fuel prior to the running of each R-49 cycle. This pre-conditioning phase allowed any changes in injector deposit levels, associated with the change in fuel composition, to stabilise before measurement of emissions.

The tests were carried out on untreated fuel and on fuel containing each of the additive formulations below.

The fuel used had the same characteristics as the fuel used in Example 1.

The additive formulations tested were as follows:

A. A polyisobutylene-substituted succinimide polyamine dispersant where the isobutylene had a number average molecular weight of about 950 as measured by Gel Permeation Chromatography and the polyamine was a commercially available mixture of polyamines, principally ethylene diamines heavier than triethylene tetramine (200 ppm); an allenyl phenol polyol anti-rust compound (20 ppm); a Mannich base stabiliser (30 ppm).

B. The same dispersant as in formulation A (200 ppm); an octyl nitrate cetane improver (760 ppm); and other components known to have no significant effect on emissions.

1. Formulation B; and a polyisobutylene of number average molecular weight 450 (500 ppm).

The concentration of each component of the formulations when dissolved in the fuel is indicated in parentheses as weight per weight of fuel. Additive formulations A and B are for comparison with additive formulation 1 which is of the invention.

The results are summarised in Table 3 below.

TABLE 3

| | Additive Concentration (ppm) | HC | CO | $NO_x$ | Particulates |
|---|---|---|---|---|---|
| Untreated Fuel | 0 | 1.584 | 3.964 | 8.2587 | 0.9209 |
| Fuel + A | 250 | 0.9532 | 3.662 | 8.8322 | 0.7796 |
| Fuel + B | 1120 | 0.8834 | 3.388 | 8.2778 | 0.7804 |
| Fuel + 1 | 1620 | 0.9047 | 3.357 | 8.3092 | 0.7384 |

All figures represent quantities as in Example 1.

The test results illustrate the enhanced reduction of particulate emissions imparted by the additive of this invention upon addition to formulation B, itself known in the art for reducing particulate emissions via a reduction in injector fouling. This further reduction of 4.5% in particulate emissions may therefore be attributable predominantly to the 'direct' effect, deposit levels already having been controlled by the presence of B in the fuel.

We claim:

1. A fuel oil composition comprising a major proportion of a middle distillate fuel oil and a 5,000 ppm of an additive consisting essentially of polyisobutylene having a number average molecular weight of 450 (as measured by GPC).

2. The composition of claim 1 wherein the additive is present in combination with 5 to 500 ppm one or more oil-soluble ashless dispersants and/or one or more cetane improvers.

3. The composition of claim 2 wherein one of the dispersants is an oil soluble compound of the formula

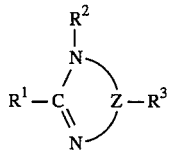

(I)

or $$R^6R^4N(R^5)_b[NR^4(R^5)_c]_dNR^4R^4$$

or mixtures of two or more such compounds, wherein $R^1$, $R^2$ and $R^3$ may be the same or different and are independently hydrogen or a hydrocarbyl substituent having from 2 to 600 carbon atoms, or a keto, hydroxy, nitro, cyano, or alkoxy derivative thereof, provided that at least one of $R^1$, $R^2$ and $R^3$ is a hydrocarbyl substituent having from 2 to 600 carbon atoms or said derivative thereof, or wherein $R^1$ and $R^2$ together from a hydrocarbylene substituent having 4 to 600 carbon atoms or a keto, hydroxy, nitro, cyano or alkoxy derivative thereof, provided that $R^1$ and $R^2$ together with the carbon atom which forms the C—$R^1$ bond with $R^1$ and the nitrogen atom which forms the NR— $R^2$ bond with $R^2$ form a ring having at least 5 members, wherein Z represents $$—R^{10}[NR^{11}(R^{10})]_e—$$

$$—[R^{10}R^{11}N]_fR^{10}[NR^{11}R^{10}]_g—$$

wherein each $R^{10}$, which may be the same or different, represents an alkylene group having from 1 to 5 carbon atoms in its chain, $R^{11}$ represents a hydrogen atom or a hydrocarbyl group, and e is from 0 to 6, f is from 1 to 4, g is from 1 to 4, provided that f+ g is at most 5, each $R^4$ is independently H or an alkyl group having up to 5 carbon atoms, $R^5$ is an alkylene group having up to 6 carbon atoms in the chain, optionally substituted by one or more hydrocarbyl groups having up to 10 carbon atoms, an acyl group having from 2 to 10 carbon atoms, or a keto, hydroxy, nitro, cyano or alkoxy derivative of a hydrocarbyl group having from 1 to 10 carbon atoms or of an acyl substituted by one or more hydrocarbyl groups having up to 10 carbon atoms, an acyl group having from 2 to 10 carbon atoms, or a keto, hydroxy, nitro, cyano or alkoxy derivative of a hydrocarbyl group having from 1 to 10 carbon atoms or of an acyl group having from 2 to 10 carbon atoms, $R^6$ is a hydrocarbyl substituent having from 2 to 600 carbon atoms or said derivative thereof, b is from 1 to 6, c is from 1 to 6 and d is from 0 to 12.

4. The composition of claim 2 wherein one of the dispersants is a hydrocarbyl-substituted succinimide or succinamide.

5. The composition of claims 1, 3 or 4 wherein a cetane improver is present as the one or more co-additive.

* * * * *

UNITED STATES PATENT AND TRADEMARK OFFICE

CERTIFICATE OF CORRECTION

PATENT NO. : 5,460,633

DATED : Oct. 24, 1995

INVENTOR(S) : A. K. Smith, et al

It is certified that error appears in the above-indentified patent and that said Letters Patent is hereby corrected as shown below:

Column 9,

In claim 1, at line 57, preceding the term "5,000", delete the term "a".

Column 10,

In claim 3, at line 28, change "NR—$R^2$" to --N—$R^2$--, and at line 32, between the formulas, insert the term --or--.

Signed and Sealed this

Ninth Day of July, 1996

Bruce Lehman

*Attest:*

BRUCE LEHMAN

*Attesting Officer*

*Commissioner of Patents and Trademarks*